US009133582B2

(12) United States Patent
Propst, Jr.

(10) Patent No.: US 9,133,582 B2
(45) Date of Patent: Sep. 15, 2015

(54) LINER/MEDIUM/PAPER/FOR LAMINATED PANEL

(75) Inventor: Charles W. Propst, Jr., Gettysburg, PA (US)

(73) Assignee: SPECTRA-KOTE CORPORATION, Gettysburg, PA (US)

( * ) Notice: Subject to any disclaimer, the term of this patent is extended or adjusted under 35 U.S.C. 154(b) by 507 days.

(21) Appl. No.: 14/112,001

(22) PCT Filed: Apr. 14, 2011

(86) PCT No.: PCT/US2011/032518

§ 371 (c)(1),
(2), (4) Date: Dec. 20, 2013

(87) PCT Pub. No.: WO2011/130527

PCT Pub. Date: Oct. 20, 2011

(65) Prior Publication Data

US 2014/0113148 A1 Apr. 24, 2014

Related U.S. Application Data

(60) Provisional application No. 61/324,226, filed on Apr. 14, 2010.

(51) Int. Cl.

| | |
|---|---|
| ***D21H 19/82*** | (2006.01) |
| ***D21H 17/63*** | (2006.01) |
| ***D21H 21/14*** | (2006.01) |
| ***D21J 1/08*** | (2006.01) |
| ***D21J 1/16*** | (2006.01) |
| ***D21H 19/56*** | (2006.01) |
| ***D21H 19/58*** | (2006.01) |
| ***D21H 19/60*** | (2006.01) |
| ***D21H 19/62*** | (2006.01) |

(52) U.S. Cl.

CPC ..... *D21H 19/82* (2013.01); *D21H 17/63* (2013.01); *D21H 19/56* (2013.01); *D21H 19/58* (2013.01); *D21H 19/60* (2013.01); *D21H 19/62* (2013.01); *D21H 19/822* (2013.01); *D21H 21/14* (2013.01); *D21J 1/08* (2013.01); *D21J 1/165* (2013.01)

(58) Field of Classification Search

CPC ..... Y10T 428/1303; Y10T 428/24455; Y10T 428/24463; Y10T 428/24934; Y10T 428/249926; Y10T 428/31775; Y10T 428/31993

USPC ..... 428/323

See application file for complete search history.

(56) References Cited

U.S. PATENT DOCUMENTS

| | | | |
|---|---|---|---|
| 3,196,038 | A | 7/1965 | Schoch et al. |
| 4,452,723 | A | 6/1984 | Carstens |
| 5,763,100 | A | 6/1998 | Quick et al. |
| 7,429,309 | B2 | 9/2008 | Propst, Jr. et al. |
| 2009/0202852 | A1 | 8/2009 | Chen |

*Primary Examiner* — Samir Shah

(74) *Attorney, Agent, or Firm* — Novak Druce Connolly Bove+Quigg LLP

(57) ABSTRACT

A laminated panel formed of a paper coated with three layers. The paper can be selected from liner, medium or other paper. The first layer comprises an acrylic containing polymer a clay synthetic polyethylene, a defoamer a cross-linking agent water and optionally a pigment. The second layer comprises a polymethyl methylacrylate polymer a synthetic polyethylene a clay a defoamer and water. A third layer comprises colloidal silica urea water and a defoamer. Composites of the above paper bonded to an expanded polystyrene block are also disclosed.

2 Claims, 1 Drawing Sheet

LINER/MEDIUM/PAPER/FOR LAMINATED PANEL

CROSS REFERENCE TO RELATED APPLICATIONS

This applicalion is a 35 U.S.C. §371 National Slage of PCT/US11/32518, filed Apr. 14, 2011; which, in turn, claims benefit of U.S. Provisional Application 61/324,226, filed on Apr. 14, 2010.

FIELD

The following relates to a coating for a laminated panel, and more particularly to a coating for a laminated construction panel.

BACKGROUND

As described in U.S. Pat. No. 7,429,309 B2 to Propst, Jr. et al., which is hereby incorporated by reference in its entirety, modern developments in the art of "papermaking" resulted in the widely accepted Fourdrinier process (See generally Kirk-Othmer Encyclopedia of Chemical Technology, 3rd ed., Vol. 9, pp. 846-7, John Wiley & Sons, New York 1980, herein incorporated by reference in its entirety), in which a "furnish" (a "furnish" is predominantly water, e.g., 99.5% by weight and 0.5% "stock", i.e., virgin, recycled or mixed virgin and recycled pulp of wood fibers, fillers, sizing and/or dyes) is deposited from a headbox on a "wire" (a fast-moving foraminous conveyor belt or screen) which serves as a table to form paper. As the furnish moves along, gravity and suction boxes under the wire draw the water out. The volume and density of the material and the speed at which it flows onto the wire determine the paper's final weight. Typically, after the paper leaves this "wet end" of the papermaking machine, it still contains a predominant amount of water. Therefore, the paper enters a press section, generally comprising a series of heavy rotating cylinders, which press the water from the paper, further compacting it and reducing its water content, typically to 70% by weight. Thereafter, the paper enters a drying section. Typically, the drying section is the longest part of the paper machine. For example, hot air or steam heated cylinders may contact both sides of the paper, evaporating the water to a relatively low level, e.g., no greater than 10%, typically 2-8% and preferably 5% by weight of the paper. Following the drying section, the paper optionally passes through a sizing liquid to make it less porous and to help printing inks remain on the surface instead of penetrating the paper. The paper can go through additional dryers that evaporate any liquid in the sizing and coating. Calenders or polished steel rolls make the paper even smoother and more compact. While most calenders add gloss, some calenders are used to create a dull or matte finish. The paper can be wound onto a "parent" reel and taken off the paper making machine. The paper on the parent reel can be further processed, such as on a slitter/winder, into rolls of smaller size or fed into sheeters, such as folio or cut-size sheeters, for printing end uses or even office application. The paper can then be coated.

Commercial sub-roofing can include a liner/medium/paper laminated to a layer of expanded polystyrene (EPS). The liner/medium/paper can include glass fibers, typically, in an amount of from 10-25% by weight of the total weight of the liner/medium/paper. In some cases, the glass fibers can provide fire retardant properties. The fire resistant value can be approximately Class A surface flame spread. The final laminated sub-roofing sheet can vary in thicknesses from 1 to 4 inches. The sheet typically has dimensions of 4 feet by 8 feet, corresponding to a standard dimension used in the construction industry. Other sizes may be available for edge finishing of a roof or for custom dimensions of a roof. If the EPS is not laminated electric, air-driven, or manual hammer would be more likely to damage the EPS. With a lamination no damage is incurred to the surface of the EPS when the roofing nail or rivet is driven into the surface.

The color of the liner/medium/paper is typically a medium gray. The liner/medium/paper construction can be resistant to warping when exposed to the elements. A standard test of the current laminated liner/medium/paper EPS product is placing the standard 4'×8' by variable thickness on blocks and flooded with water and allowed to dry in the hot sun or the cold windy weather and not have warping.

Adding glass fibers to such liner/medium/paper is disadvantageous, because special mills are needed to incorporate the glass fibers and paper fiber to create the current laminating product for the EPS sub-roofing market. It would be desirable to enable any and all paper mills to supply a non-glass fibers blend for sourcing to the sub-roofing market. It would be desirable to develop a liner/medium/paper that mimics the current functions and characteristics of liner/medium/paper that is currently laminated to EPS for commercial sub-roofing. The liner/medium/paper should resist warping of the EPS under severe weather conditions; maintain the gray color (as tested by a trained human eye or by various types of computerized color matching systems) of the existing product; not be slippery during handling and packing; not cause blocking or sticking when the final product is stacked; achieve the correct angle of slide; consistently maintaining the correct resistance to the weather conditions test performances; and have suitable flame resistance and flame spreading properties.

BRIEF DESCRIPTION OF THE DRAWINGS

In order to further explain describe various aspects, examples, and inventive embodiments, the following figures are provided.

Figure 1:
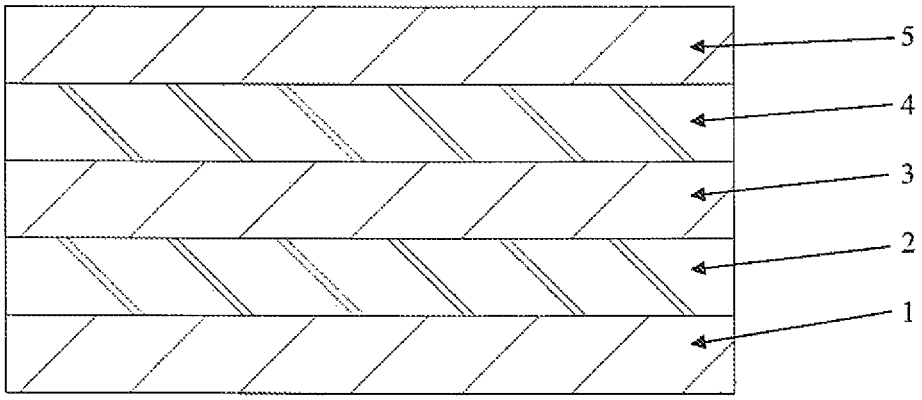
FIG. 1 depicts a schematic of an embodiment of a liner/medium/paper according to one embodiment.

It should be understood that the various embodiments are not limited to the arrangements and instrumentality shown in the drawings.

DETAILED DESCRIPTION

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure. Numerical ranges include all values within the range. For example, a range of from 1 to 10 supports, discloses, and includes the range of from 5 to 9. Similarly, a range of at least 10 supports, discloses, and includes the range of at least 15. It should be understood that throughout this specification and claims, "coating" means "coating" or "impregnation" unless otherwise indicated.

The following disclosure describes various examples and embodiments of liner/medium/paper to coat expanded polystyrene (EPS). Many other examples and other characteristics will become apparent from the following description.

One embodiment includes the addition of at least one hydrocarbon dimer, such as alkyl ketene dimer (AKD), and/or alkyl succinic anhydride (ASA), as used herein "ASA" may also include alkenyl succinic anhydride. "AKD" may also include alkenyl ketene dimer. For example, in the size press or calendar stack and most often in the wet end. The addition of at least one hydrocarbon dimer or similar wet end additives can create a zero edge wicking characteristic, and can be all that is required to make the paper (medium) work successfully and to provide weather resistance and curling resistance.

Another embodiment involves coating liner/medium/paper. The liner/medium/paper can, but need not include a hydrocarbon dimer as previously discussed. One or more coatings, for example three coatings can be applied to the liner/medium/paper. The coatings can be applied in any order, for example, the first coating layer can be applied to the liner/medium/paper, the second coating layer can be applied to the first coating layer, and the third coating layer can be applied to the second coating layer.

The first coating layer can comprise: from 21 to 39% by weight of an acrylic containing polymer, such as poly(methyl methacrylate) (hereinafter, "PMMA") for example 30% by weight PMMA; from 28 to 52% by weight of a water-based polymer for example 40% by weight of a water-based polymer; from 11.9 to 22.1% by weight clay powder for example 17% by weight clay powder; from 1.4 to 2.6% by weight synthetic PE for example 2 by weight synthetic polyethylene (hereinafter, "PE"); from 0.35 to 0.65% by weight of a defoamer for example 0.5% by weight of a defoamer; from 2.1 to 3.9% by weight of a cross-linking agent for example 3% by weight of a cross-linking agent; from 5.25 to 9.75% by weight of water for example 7.5% by weight of water; and optionally from 1.47 to 2.73% by weight pigment for example 2.1% by weight pigment. The ratios can be selected to create a target 30 minute Cobb. Surface water absorption over 30 minutes, expressed in $g/m^2$, can be measured by Cobb Test (see TAPPI T 441, herein incorporated by reference in its entirety).

The water-based polymer can be Styrene Butadiene Rubber Latex (hereinafter, "SBR Latex"), a Polyethylene terephthalate (hereinafter, "PET") water based polymer, such as can be obtained from EVCO Chemical, and Polyvinylidene Chloride (hereinafter, "PVDC"), such as can be obtained from DOW Chemical.

The cross-linking agent can be an organic or inorganic material. The cross-linking agent selected from the group consisting of ammonium oxide, calcium oxide, magnesium oxide, magnesium stearate, isostearate, calcium stearate, stannous oxide, tungsten oxide, sodium tungstate sodium tungstate dehydrate, zinc octoate, aluminum stearate, aluminum oxide, zinc salts of fatty acids, zinc oxide, zirconium oxide, calcium isostearate, calcium salts of fatty acids, magnesium salts of fatty acids, and aluminum salts of fatty acids; and wood fibers; wherein the acrylic acid containing material is poly(methylmethacrylate). Without wishing to be bound by any particular theory, the presence of zinc oxide is believed to impart a desirable flame resistant quality to the liner/medium/paper. The presence of zinc oxide can improve the fire rating of the laminate.

The optional pigment can be added to make the liner/paper/medium match the gray color of current paper/fiberglass blend used in the industry to facilitate customer acceptance of the product. The pigment can comprise: from 0.01148 to 0.02132% by weight $TiO_2$ Powder for example 0.0164% by weight $TiO_2$ Powder; from 0.00266 to 0.00494% by weight black pigment suspended in water dispersion for example 0.0038% by weight black pigment suspended in water dispersion; and from 0.00028 to 0.00052% by weight organic yellow pigment for example 0.0004% by weight organic yellow pigment. The black pigment can be carbon black.

The second coating layer can comprise: from 53.2 to 98.8% by weight PMMA for example 76% by weight PMMA; from 0.35 to 0.65% by weight synthetic PE for example 0.5% by weight synthetic PE; from 12.6 to 23.4% by weight clay powder for example 18% by weight clay powder; from 0.35 to 0.65% by weight defoamer for example 0.5% by weight defoamer; and from 3.5 to 6.5% by weight water for example 5% by weight water. The ratios can be selected to create a target 30 minute Cobb. Surface water absorption over 30 minutes, expressed in $g/m^2$, can be measured by Cobb Test (see TAPPI T 441, herein incorporated by reference in its entirety).

The third coating layer can be a non-skid non-tac colloidal silica layer. The third coating layer can comprise: from 28 to 52% by weight colloidal silica for example 40% by weight colloidal silica; from 11.9 to 22.1% by weight urea for example 17% by weight urea; from 30.1 to 55.9% by weight water for example 43% by weight water; and from 0.35 to 0.65% by weight defoamer for example 0.5% by weight defoamer. The colloidal silica can be obtained from any source, for example from DuPont or EKA Chemical. When EKA Chemical is the source, the specific colloidal silica formulation can be the formulation sold as Bindzil DP3900EC. The colloidal silica can also be Ludux CL-X, as can be obtained from W. R. Grace & Co. The urea can be granular or in the form of pellets.

Some embodiments include a clear polyethylene stretch wrap. The stretch wrap can be applied directly to the liner/medium/paper or can be applied to the outer most coating layer, for example to the third coating layer. Including the clear polyethylene stretch wrap can prevent any slippery handling issues and avoid blocking that can occur during the final packing phase of stacking hot sheets of 4-foot by 8-foot by 1-inch thick to 4-inch thick sheets of liner/medium/paper laminated EPS with clear polyethylene stretch wrap.

The polyethylene is merely a stretch wrap for storing and shipping the panels from point A to point B. When the polyethylene stretch wrap is used without the third coating layer, some "tackiness" has been observed when the polyethylene wrap was taken off and the EPS panels were slightly stuck together. This problem can be resolved by applying a thin layer of Colloidal Silica to the top surface of the coatings being used. The Colloidal Silica can remove the tackiness and can help ensure the angle of slide (hereinafter, "AOS") is not too low so as to cause the panels to slide more than desired by the construction personnel that handles the coated liner/medium/paper lamination.

Referring to FIG. 1, a schematic of an embodiment of a liner/medium/paper according to one embodiment is shown. The liner/medium/paper (1) is coated with a first coating layer (2). The first coating layer (2) is coated with a second coating layer (3). The second coating layer (3) is coated with a third coating layer (4). The third coating layer is coated with a stretch wrap layer (5).

It is desirable to minimize the coat weight, while maintaining the weather conditions test resistance. Minimizing the coat weight can improve the price point on the product. Total surface coat weight can range from 0% (and the function is available via the wet end AKD or ASA) to a maximum surface coat weight of 10.0 wet pounds per one thousand square feet, with the average solids of each formula being 40%-45%.

The liner/medium/paper can be laminated to a block of expanded polystyrene (EPS). The heat of expansion of the EPS and having forms to control the thickness of the EPS also permits for the bonding of the EPS to the paper. There have been no issues with bonding the coated/treated liner/paper/medium to the EPS in the standard production process.

Figure 2:
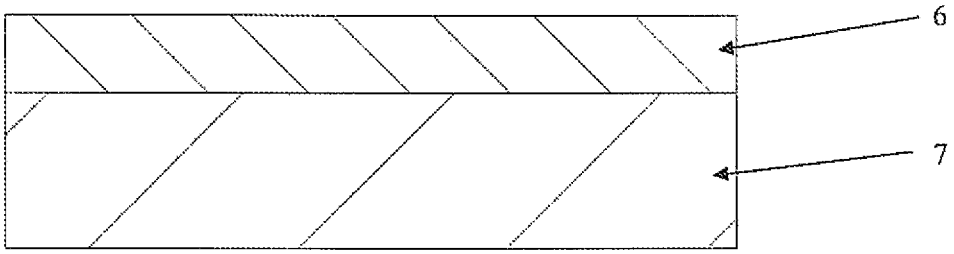
FIG. 2 depicts a schematic of a liner/medium/paper according to one embodiment laminated to a layer of expanded polystyrene.

FIG. 2 depicts a schematic of a liner/medium/paper (6) according to one embodiment laminated to a layer of expanded polystyrene (7).

EXAMPLES

Components

Formula A refers to a composition comprising 30 wt. % PMMA; 40 wt. % SBR Latex; 17 wt. % Clay powder; 2 wt. % Synthetic PE; 0.5 wt. % Defoamer; 3 wt. % Zinc Oxide; 7.5 wt. % $H_2O$.

Formula B refers to a composition comprising 30 wt. % PMMA; 20 wt. % SBR Latex; 20 wt. % Synthetic PE; 15 wt. % Clay Powder; 0.5 wt. % Defoamer; 14.5 wt. % $H_2O$ Gray tint formula refers to a composition comprising 0.0164 wt. % $TiO_2$ powder; 0.0038 wt. % black pigment suspended in water dispersion; 0.0004 wt. % organic yellow pigment.

Substrate refers to a 40#/MSF medium from the Greif mill in Massillon, Ohio. The substrate could be substituted with liner or paper grade stock (i.e. multi-wall and single wall bags).

Spectra-Guard™ Soft is a $C_{10}$-$C_{18}$ alcohol ethoxylate.

Spectra-Guard™ NS-2 is a coating layer that can comprise: from 28 to 52% by weight colloidal silica for example 40% by weight colloidal silica; from 11.9 to 22.1% by weight urea for example 17% by weight urea; from 30.1 to 55.9% by weight water for example 43% by weight water; and from 0.35 to 0.65% by weight defoamer for example 0.5% by weight defoamer.

Application Processes

Spectra-Shield™ 48 refers to a process whereby a first coating of Formula A is applied to a substrate using a #4 rod on a rod coater, and then a second coating of Formula A is applied using a #8 rod on a rod coater. The 4 rod of the first coating and the #8 rod applying the second coating results in a coat weight of 10 wet lb/MSF.

Spectra-Shield™ 88 refers to a process whereby a first coating of Formula A is applied to a substrate using a #8 rod on a rod coater, and then a second coating of Formula A is applied using a #8 rod on a rod coater. This process results in a heavier application, specifically a coat weight of 11 wet lb/MSF.

Spectra-Release™ 410 refers to a process whereby a coating of Formula A is applied to a substrate using a #4 rod on a rod coater, and then a coating of Formula B is applied using a #10 rod on a rod coater. This process results in a coat weight of 12 wet lb/MSF, because the #10 rod is coarser than any previous rod.

Spectra-Release™ 810 refers to a process whereby a coating of Formula A is applied to a substrate, using a #8 rod on the rod coater, and then a coating of Formula B is applied using a 410 rod on a rod coater. The combination of the #8 rod and the 410 rod will apply more of the same coating as that used in the Spectra-Release™ 410 application for a coat weight of 13 wet lb/MSF.

Spectra-Shield™ 48 w/Spectra-Guard™ NS-2 (non-skid and non-block coating) refers to a process whereby a first coating of Formula A is applied to a substrate using a #4 rod a on a rod coater, then a second coating of Formula A is applied using a #8 rod on a rod coater, and finally a coating of Spectra-Guard™ NS-2 is applied using a Gravure Press with an anilox roll with a cell volume of 21 BCM which equals 1 wet lb/MSF of application. This process results in a total coat weight of 11 wet lb/MSF including 1 wet lb/MSF Spectra-Guard™ NS-2.

Sustaina-Guard™ 824 w/Spectra-Guard™ NS-2 refers to a process whereby a first coating of Formula A is applied to a substrate using a #8 rod on a rod coater, then a second coating of Formula A is applied using a Gravure press anilox roll with a 21 BCM cell volume to apply 1 wet lb/MSF, and then a coating of Spectra-Guard™ NS-2 is applied using a Gravure press anilox roll with a 21 BCM cell volume to apply 1 wet lb/MSF. This process results in a total coat weight of 10 wet lb/MSF including one wet lb/MSF is SG-NS-2.

Sustaina-Guard™ 424 w/Spectra-Guard™ NS-2 refers to a process whereby a first coating of Formula A is applied to a substrate using a #4 rod on a rod coater; then a second coating of Formula A is applied using a Gravure press anilox roll with 21 BCM cell volume to apply 1 wet lb/MSF, and then a coating of Spectra-Guard™ NS-2 is applied using a Gravure press roll with a 21 BCM cell volume to apply 1 wet lb/MSF. This process results in a total coat weight of 7 wet lb/MSF.

Examples 1-7

All of the coating worked in the weather testing and the blocking and slip issues were resolved using the Spectra-Guard™ NS-2 as a top coat on all three new conditions.

Example 1

A substrate was coated according to Spectra-Shield™ 48, wherein a Gray tint formula was added to the coating formulas.

Example 1A

A substrate was coated according to Spectra-Shield™ 48 without Gray tint formula.

Example 2

In order to evaluate the possibility of relaxing the curl issue for the end-use customer. A first coating layer (a pre-coat layer) comprising Spectra-Guard™ Soft was applied to a substrate. Subsequently, the substrate was coated according to Spectra-Shield™ 48, wherein a Gray tint formula was added to the coating formulas.

Example 2A

A first coating layer comprising Spectra-Guard™ Soft was applied to a substrate. Subsequently, the substrate was coated according to Spectra-Shield™ 48 without gray tint formula.

Example 3

A substrate was coated according to Spectra-Shield™ 88, wherein a Gray tint formula was added to the coating formulas.

Example 3A

A substrate was coated according to Spectra-Shield™ 88 without gray tint formula.

Example 4

A first coating layer (a pre-coat layer) comprising Spectra-Guard™ Soft was applied to a substrate. Subsequently, the substrate was coated according to Spectra-Shield™ 88, wherein gray tint formula was added to the coating formulas.

Example 4A

A first coating layer comprising Spectra-Guard™ Soft was applied to a substrate. Subsequently, the substrate was coated according to Spectra-Shield™ 88 without gray tint formula.

Example 5

A substrate was coated according to Spectra-Release™ 410, wherein a Gray tint formula was added to the coating formulas.

Example 5A

A substrate was coated according to Spectra-Release™ 410 without gray tint formula.

Example 6

A first coating layer (a pre-coat layer) comprising Spectra-Guard™ Soft was applied to a substrate. Subsequently, the substrate was coated according to Spectra-Shield™ 410, wherein gray tint formula was added to the coating formulas.

Example 6A

A first coating layer comprising Spectra-Guard™ Soft was applied to a substrate. Subsequently, the substrate was coated according to Spectra-Shield™ 410 without gray tint formula.

Example 7

As a control for weather testing, the current fiber/fiberglass blend of gray paper was tested.

The results are summarized in Table 1.

TABLE 1

| Example | 30 Minute Cobb[1] | E-84 Flame Tunnel tests[2] | Porosity before final coat is applied[3] | Porosity after final coat is applied[4] | Thickness Ratio (Medium to Finished)[5] |
|---|---|---|---|---|---|
| 1 | 16 | Class B | n/a | 5,000+ seconds | 12.5/12.5 thousandths before/after |
| 1A | 16 | Class B | n/a | 5,000+ seconds | 12.5/12.5 |
| 2 | 20 | Class B | n/a | 5,000+ seconds | 12.5/12.5 |
| 2A | 20 | Class B | n/a | 5,000+ seconds | 12.5/12.5 |
| 3 | 10 | Class B | n/a | 5,000+ seconds | 12.5/12.5 |
| 3A | 10 | Class B | n/a | 5,000+ seconds | 12.5/12.5 |
| 4 | 9 | Class B | n/a | 5,000+ seconds | 12.5/12.5 |
| 4A | 9 | Class B | n/a | 5,000+ seconds | 12.5/12.5 |
| 5 | 7 | Class B | n/a | 5,000+ seconds | 12.5/12.5 |
| 5A | 7 | Class B | n/a | 5,000+ seconds | 12.5/12.5 |
| 6 | 3 | Class B | n/a | 5,000+ seconds | 12.5/12.5 |
| 6A | 3 | Class B | n/a | 5,000+ seconds | 12.5/12.5 |
| 7 | | Class A | 5 seconds | n/a | 17.5/n/a |

TABLE 1-continued

| Example | 30 Minute Cobb[1] | E-84 Flame Tunnel tests[2] | Porosity before final coat is applied[3] | Porosity after final coat is applied[4] | Thickness Ratio (Medium to Finished)[5] |
|---|---|---|---|---|---|

[1]Surface water absorption over 30 minutes, expressed in g/m$^2$, can be measured by Cobb Test (see TAPPI T 441).
[2]See ASTM E84 Standard Test Method for Surface Burning Characteristics of Building Materials.
[3]Porosity is reported in seconds. The current Fiber/Fiberglass product had a porosity of 5 seconds using the Teledyne-Gurley model 4110. (anything under 100 seconds needs to be measured on this unit, which is designed for evaluating plain paper/liner/medium.
[4]Porosity was measured by Teledyne-Gurley model 4050CN. It is reported in seconds.
[5]The ratio of the thickness of the medium to the thickness of the finished product after all coatings were applied was tested with calipers.

Each of the Examples 1-7 were laminated to a block of expanded polystyrene. The panel were wetted with a garden hose and allowed to dry under extreme cold and extreme heat. The process of lamination and a subsequent weather study was a success. This at least indicates that the Spectra-Guard™ Soft is not required to prevent the fibers from curling under wet to dry weather.

Spectra-Shield™ 48 exhibited the lowest coat weight of all Conditions tested. Coat weight for Spectra-Shield™ 48 was 10 wet pounds per one thousand square feet. Spectra-Shield™ 88 was 11 wet pounds per one thousand square feet. The Spectra-Release™ 410 was 12 wet pounds per one thousand square feet. The Spectra-Release™ 810 was 13 wet pounds per one thousand.

Examples 8-10

Additional tests were conducted to determine what coat weight will protect the EPS from weather related curl and minimize cost of the process.

Example 8 a first coating layer comprising Spectra-Shield™ 48 with Gray tint formula was applied to a substrate, was run again and used as a control. In other words, Example 1 was run again and used as a control.

Example 9

A first coating layer comprising Spectra-Shield™ 824 with Gray tint formula was applied to a substrate.

Example 10

A first coating layer comprising Spectra-Shield™ 424 with gray tint formula was applied to a substrate.

The results are summarized in Table 2.

TABLE 2

| Example | Coat Weight (wet pounds/thousand square feet) | Weather Test (Pass/Fail) |
|---|---|---|
| 8 | 10 | pass |
| 9 | 9 | pass |
| 10 | 6 | pass |

The above disclosure provides examples and aspects relating to various embodiments within the scope of claims, appended hereto or later added in accordance with applicable law. However, these examples are not limiting as to how any disclosed aspect may be implemented, as those of ordinary skill can apply these disclosures to particular situations in a variety of ways. Although the present invention has been described in considerable detail with reference to certain preferred versions thereof, other versions are possible. Therefore, the spirit and scope of the appended claims should not be limited to the description of the preferred versions contained herein. All the features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A liner/medium/paper coated with a first layer, a second layer, and a third layer, wherein the first layer comprises from 21 to 39% by weight of an acrylic containing polymer; from 28 to 52% by weight of a water-based polymer from 11.9 to 22.1% by weight clay powder; from 1.4 to 2.6% by weight synthetic polyethylene; from 0.35 to 0.65% by weight of a defoamer; from 2.1 to 3.9% by weight of a cross-linking agent; from 5.25 to 9.75% by weight of water; and optionally from 1.47 to 2.73% by weight pigment, wherein the second layer comprises from 53.2 to 98.8% by weight PMMA; from 0.35 to 0.65% by weight synthetic PE; from 12.6 to 23.4% by weight clay powder; from 0.35 to 0.65% by weight defoamer; and from 3.5 to 6.5% by weight water, and wherein the third layer comprises from 28 to 52% by weight colloidal silica; from 11.9 to 22.1% by weight urea; from 30.1 to 55.9% by weight water; and from 0.35 to 0.65% by weight defoamer.

2. A laminated product comprising the liner/medium/paper according to claim 1, bonded to an expanded polystyrene block.

* * * * *